US005160060A

United States Patent [19]

Garofalo, Jr.

[11] Patent Number: 5,160,060

[45] Date of Patent: Nov. 3, 1992

[54] APPARATUS FOR LOCKING WASTE CONTAINERS

[76] Inventor: Robert Garofalo, Jr., 124 Lalley Blvd., Fairfield, Conn. 06430

[21] Appl. No.: 829,909

[22] Filed: Feb. 3, 1992

[51] Int. Cl.[5] ..... B65D 45/00

[52] U.S. Cl. ..... 220/318; 220/908

[58] Field of Search ..... 220/315, 318, 324, 326, 220/94 R, 94 A

[56] References Cited

U.S. PATENT DOCUMENTS

| | | | |
|---|---|---|---|
| 615,478 | 12/1898 | Davenport | 220/318 |
| 1,105,440 | 7/1914 | Keen | 220/318 |
| 1,137,078 | 4/1915 | Nicodemus et al. | 220/318 |
| 2,717,167 | 9/1955 | Worth | 220/318 X |
| 3,525,429 | 8/1970 | Vaughn | 220/318 X |
| 4,476,994 | 10/1984 | Hope et al. | 220/318 |
| 4,609,125 | 9/1986 | Willingham | 220/324 |
| 4,691,840 | 9/1987 | Ferbrache | 220/318 |
| 4,819,827 | 4/1989 | DiSesa | 220/318 |
| 5,044,513 | 9/1991 | Van Berne | 220/318 |

*Primary Examiner*—Stephen Marcus
*Assistant Examiner*—Nova Stucker
*Attorney, Agent, or Firm*—Kramer, Brufsky & Cifelli

[57] ABSTRACT

A refuse container has a lid and a pair of handles, and each handle is mounted to pivot between a closed position for holding the lid on the container and an open position for removing the lid from the container. Each handle has two legs spaced apart from each other, and a locking bar is coupled between the two legs and permitted to slide along the legs between a locked position for locking the handle in the closed position to prevent access into the container, and an unlocked position for opening the handle to remove the lid. The locking bar is received within a U-shaped clamp in the locked position to retain the locking bar in the locked position. In another embodiment, the locking bar is received within a recess for retaining the locking bar in the locked position. A U-shaped handle is coupled to the locking bar to move the locking bar between the locked and unlocked positions.

16 Claims, 3 Drawing Sheets

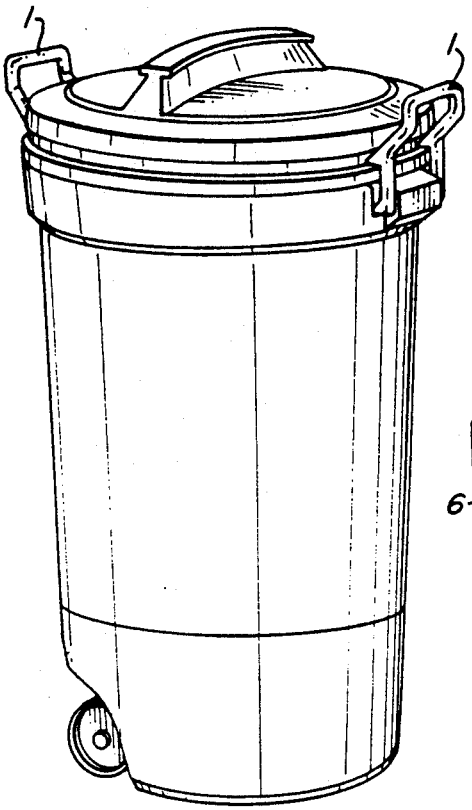
FIG. 1
(PRIOR ART)
FIG. 2
(PRIOR ART)
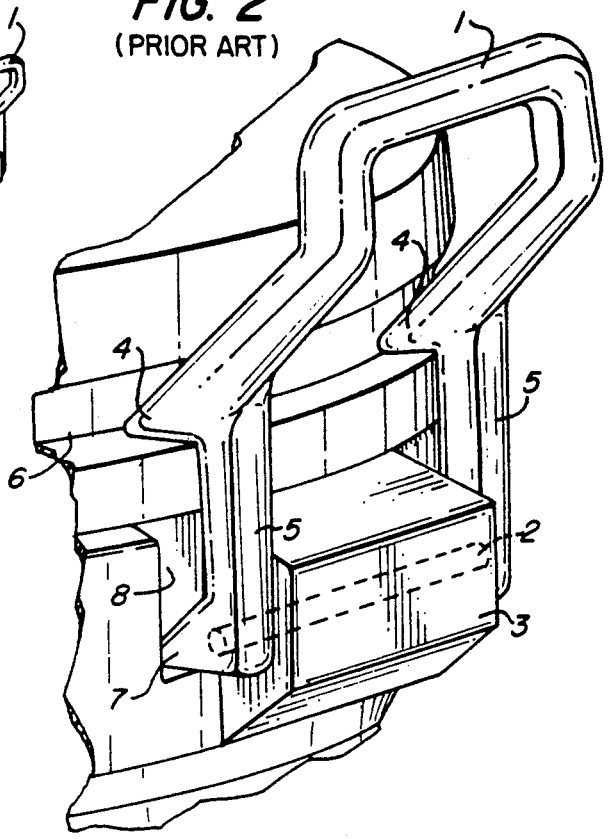
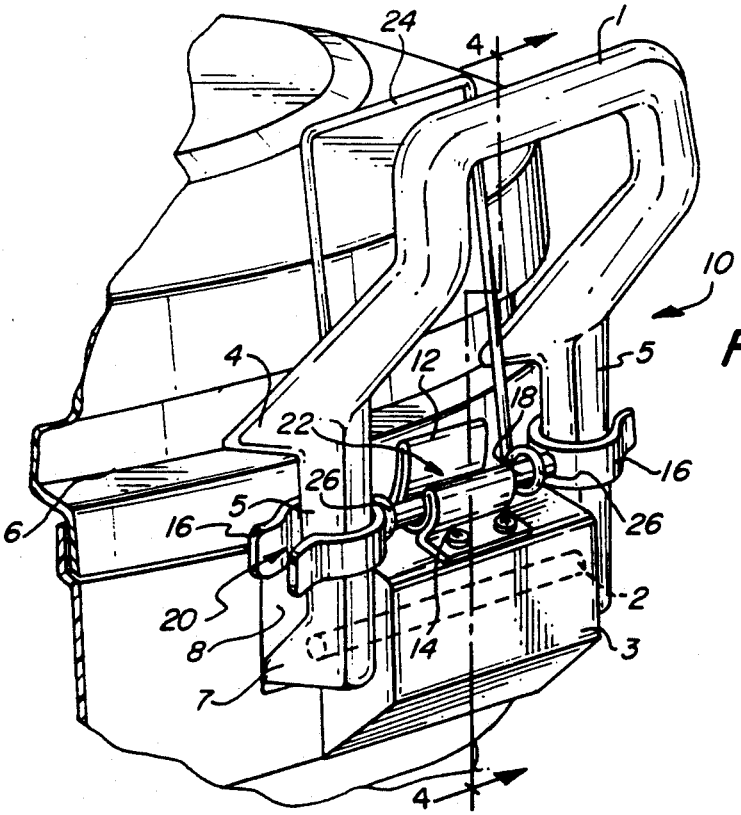
FIG. 3

APPARATUS FOR LOCKING WASTE CONTAINERS

FIELD OF THE INVENTION

The present invention relates to waste or refuse containers generally and, more particularly, to devices for locking the lids onto such containers to prevent access into the containers by animals, for example.

BACKGROUND INFORMATION

A commercially-available refuse container is illustrated in FIGS. 1 and 2, and includes a pair of handles 1 on opposite sides of the container for holding the lid in the closed position on the container. As shown in FIG. 2, each handle 1 is supported by a shaft 2 (illustrated in phantom lines) extending through a corresponding aperture in a boss 3 formed on the side of the container. Each handle 1 includes a pair of tooth-like projections 4 projecting inwardly from each leg 5 of the handle, and a corresponding groove 6 is formed in the lid immediately above the rim of the lid for receiving the tooth-like projections 4. Each handle 1 also includes a pair of lobes 7 which project inwardly from the base of each leg 5 into a corresponding recess 8 in the side of the container.

Each handle 1 is pivoted downward and away from the lid to release the lid and remove it from the container. The handles 1 are then pivoted upward and toward the lid until the tooth-like projections 4 are seated within the groove 6 and against the rim of the lid to hold the lid in the closed position, as shown in FIG. 2. When the handles 1 are rotated upward into the closed position, each lobe 7 engages the base of the corresponding recess 8 to hold the respective handle in place by friction. A refuse container similar to the container shown in FIGS. 1 and 2 is shown in U.S. Pat. No. 4,691,840.

The handles illustrated in FIGS. 1 and 2 have not been completely successful in preventing animals from gaining access to the interior of the containers. Raccoons, for example, have been able to move the handles 1 out of the way and remove the lid in order to gain access to garbage inside such containers. It is believed that such animals open the handles by pressing or falling against the upper-inside surfaces of the handles, and in turn cause the handles to rotate downward out of the closed position.

Accordingly, a convenient lid-locking mechanism has yet to be provided which can prevent animals, such as raccoons, from removing a lid and gaining access to refuse within a refuse container.

SUMMARY OF THE INVENTION

The present invention is directed to an apparatus for securing a lid on a refuse container, comprising at least one handle mounted on the container to pivot between a closed position for holding the lid on the container, and an open position for removing the lid from the container. Each handle includes a first leg spaced apart from a second leg, and a locking member extends between the first and second legs of each handle. The locking member is moveable relative to the first and second legs between a locked position for securing the handle in the closed position to prevent access to the interior of the container, and an unlocked position for permitting removal of the lid from the container.

One embodiment of the present invention comprises a clamp including a spring-biased surface for engaging the locking member and retaining the locking member in the locked position. The apparatus preferably further comprises at least one second handle coupled to the locking member for moving the locking member between the locked and unlocked positions. In another embodiment of the present invention, the locking member is received within a recess formed within the container for retaining the locking member in the locked position. The entrance to the recess is preferably defined by a surface shaped to engage the locking member by friction upon movement of the locking member into the locked position to facilitate retaining the locking member in the locked position. In a further embodiment of the present invention, each second handle extends through respective apertures defined in each leg portion.

One advantage of the apparatus of the present invention is that it provides a convenient, cost-effective mechanism for locking a lid onto a refuse container in order to prevent animals from gaining access to the interior of the container. When the locking member is located in the locked position, the apparatus of the present invention has proven to be particularly reliable in preventing even the most clever raccoons from removing the lid on the container. The apparatus of the present invention can also be easily operated by a person to either lock or unlock a lid by simply moving the locking member of the present invention between the locked and unlocked positions. As will also be recognized by those skilled in the art, another advantage of the apparatus of the present invention is that it can be easily adapted for modifying known, commercially-available refuse containers.

Other advantages of the apparatus of the present invention will become apparent in view of the following detailed description and accompanying drawings.

BRIEF DESCRIPTION OF THE DRAWINGS

FIG. 1 is a perspective view of a commercially-available refuse container.

FIG. 2 is an enlarged partial, perspective view of the refuse container of FIG. 1 illustrating a handle area of the container.

FIG. 3 is an enlarged partial, perspective view of the refuse container of FIG. 1 illustrating a handle area of the container modified to incorporate an apparatus embodying the present invention.

DETAILED DESCRIPTION

Figure 4A:
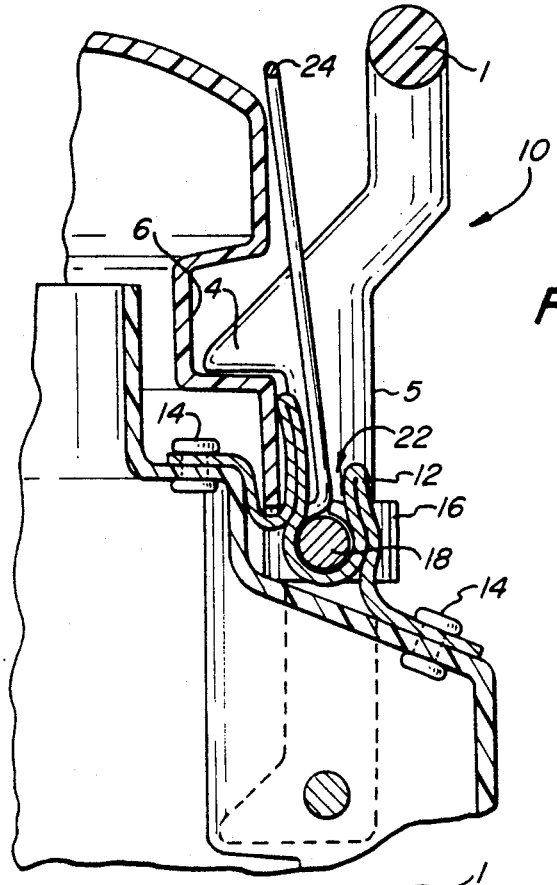
FIG. 4A is a cross-sectional view taken along the line 4-4 of FIG. 3 illustrating the apparatus of the present invention in the locked position.

In FIG. 3, an apparatus embodying the present invention is shown mounted on the refuse container of FIGS. 1 and 2 and is indicated generally by the reference numeral 10. The apparatus 10 includes a generally U-shaped clamp 12 mounted on the top surface of boss 3 which is situated along the perimeter of the lip of the container and secured to the boss by screws 14. The U-shaped clamp 12 is preferably made from a spring-like metal, but can equally be made from numerous other materials, such as a suitable plastic and formed as an integral part of the boss 3, for example.

Opposed C-shaped clamps 16 are each fitted around a respective leg 5 of the handle 1 and coupled together by a rod 18. Each C-shaped clamp 16 defines an opening 20 between the ends of the clamp which defines a width less than the thickness or diameter of the respective leg 5 of the handle 1. Each C-shaped clamp is preferably made of a spring-like metal, but can equally be made from numerous other materials, such as a suitable plastic. Thus, each C-shaped clamp 16 can be snapped over and secured to the respective leg 5, yet is permitted to slide along the surface of the leg. The U-shaped clamp 22 similarly defines a narrow slot 22 which is formed with a width less than the thickness or diameter of the rod 18. However, the width of the slot 22 is sufficiently large to permit the rod 18 to be manually pressed through the slot by forcing the spring-biased sides of the U-shaped clamp 12 outward in order to snap the rod 18 into the U-shaped clamp to secure the rod in place.

A U-shaped handle 24 is coupled to the rod 18 by circular sections 26 fitted over the rod on either end of the handle in order to permit the handle 24 to pivot about the rod. Thus, when the apparatus 10 is in the locked position as illustrated in FIG. 3, the handle 24 can be pivoted against the handle 1 and the two handles can be gripped together for lifting or otherwise moving the container.

Figure 4B:
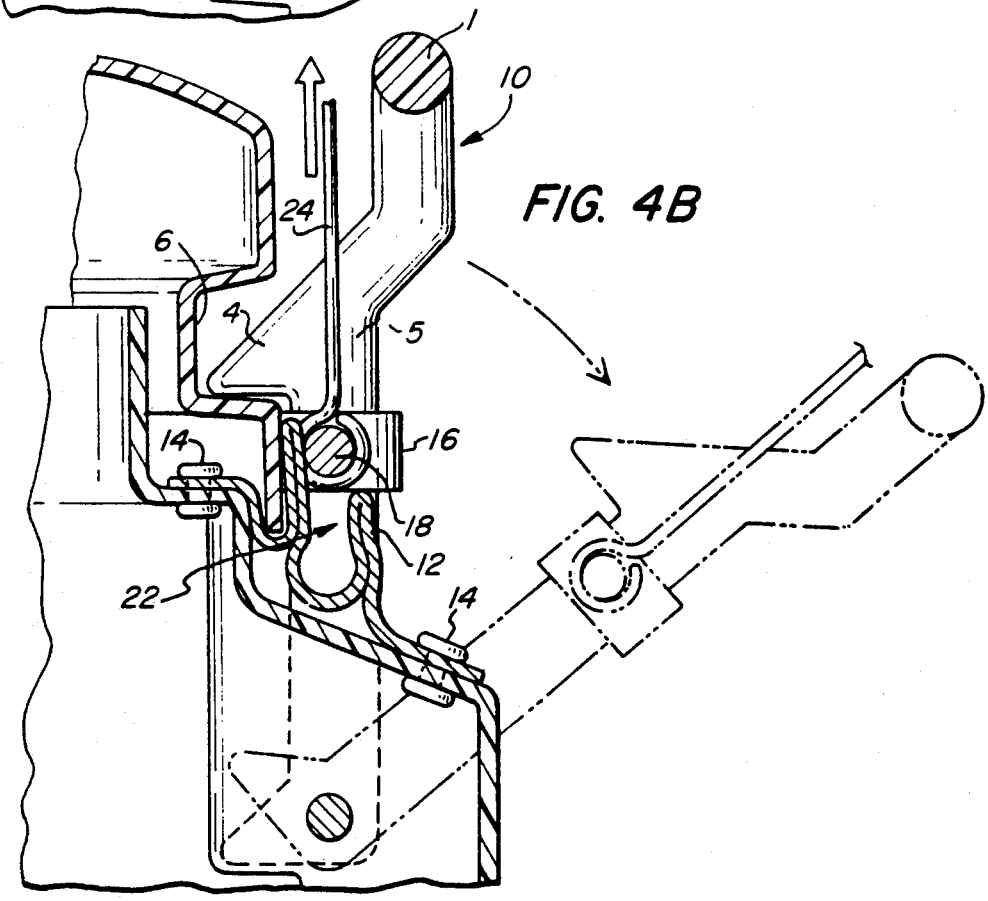
FIG. 4B is a cross-sectional view taken along the line 4-4 of FIG. 3 illustrating the unlocking operation of the apparatus of the present invention.

Turning to FIGS. 4A and 4B, the operation of the apparatus of the present invention is hereinafter described in further detail. Each handle 1 is moved into the closed position as shown in FIG. 4A by rotating the handle upward and toward the lid so that the tooth-like projections 4 are seated within the corresponding groove 6 in the lid. The apparatus 10 is then locked to fix the handle 1 (and thus the lid) in place, by pushing the U-shaped handle 24 downward until the rod 18 is seated within the U-shaped clamp 12. As a result, the handle 1 cannot be opened because it is locked in place by the C-shaped clamps 16, which are in turn secured by the rod 18 seated within the U-shaped clamp 20.

The apparatus 10 can then be easily unlocked by pulling the handle 24 upward to remove the rod 18 from the U-shaped clamp 20, as indicated by the arrow in FIG. 4B. The handle 1 can then be opened in the normal manner by simply pulling it downward and away from the lid, as indicated in phantom lines in FIG. 4B.

One advantage of the apparatus of the present invention is that it provides a convenient, cost-effective mechanism for locking a lid onto a refuse container in order to prevent animals from gaining access to the interior of the container. The apparatus 10 has proven to be particularly reliable in preventing even the most clever raccoons from removing the lid from such a container. The apparatus of the present invention can also be easily operated by a person to either lock or unlock a lid by simply pushing or pulling the rod 18 into and out of the U-shaped clamp 12 through the U-shaped handle 24. As will also be recognized by those skilled in the art, another advantage of the apparatus of the present invention is that it can be easily adapted for modifying known, commercially- available refuse containers, as illustrated in FIGS. 3 through 4B.

Figure 5:
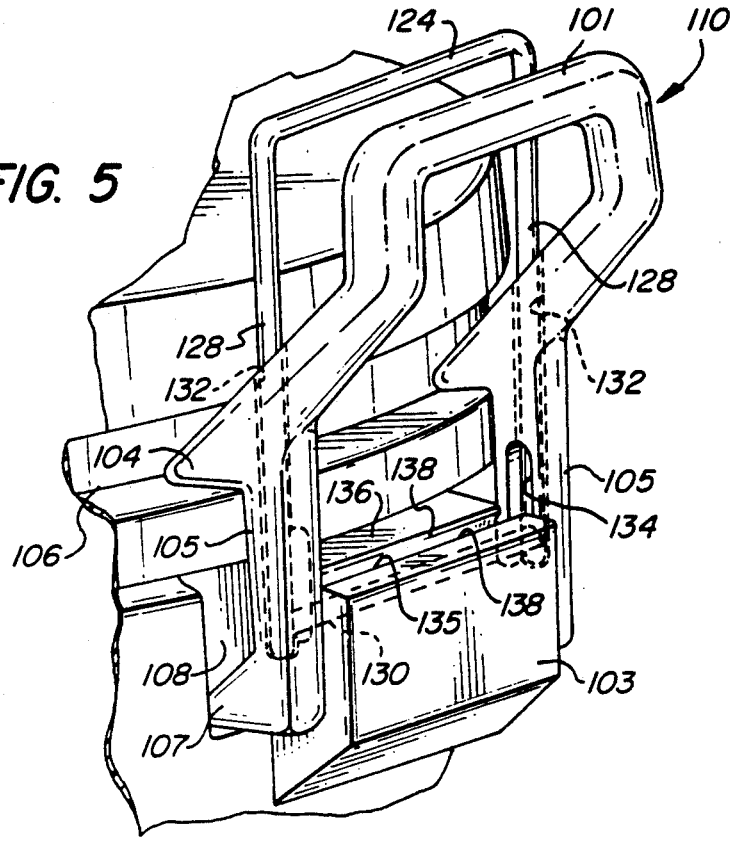
FIG. 5 is a partial, perspective view of another embodiment of the present invention.
Figure 6:
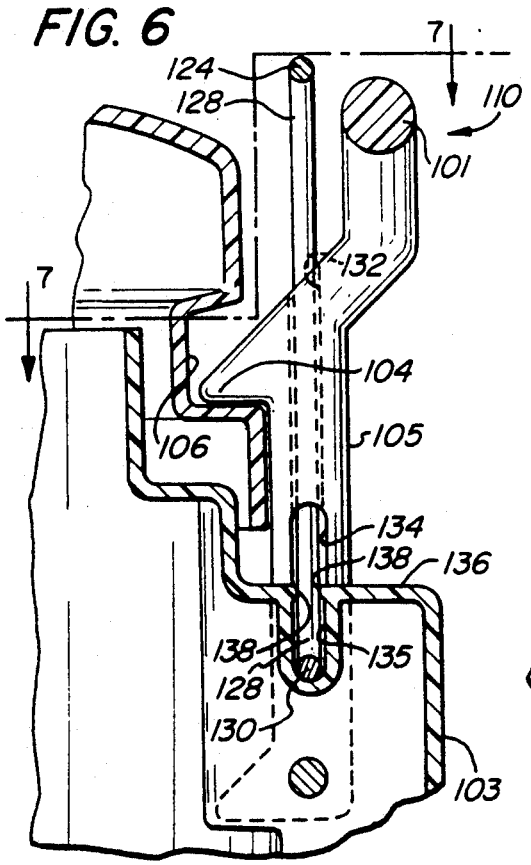
FIG. 6 is a cross-sectional view of FIG. 5.
Figure 7:
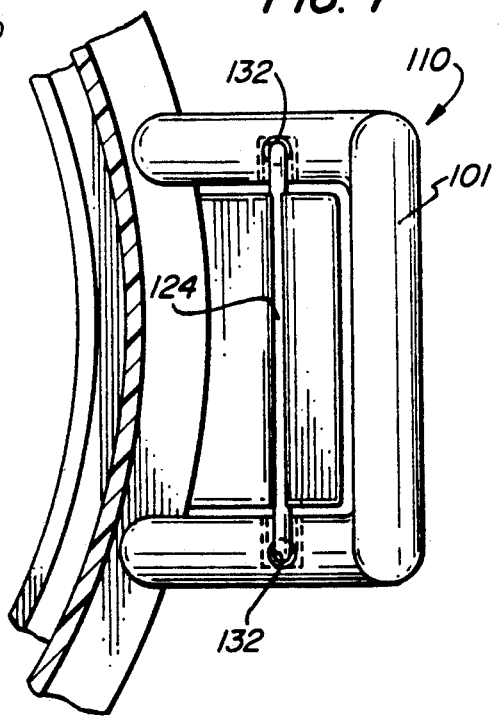
FIG. 7 is a sectional view of the apparatus of FIG. 6 taken along line 6—6 of FIG. 6.

In FIGS. 5 through 7 another embodiment of the present invention is indicated generally by the reference numeral 110. The apparatus 110 is similar to the apparatus 10 described above with reference to FIGS. 3 through 4B, and therefore like reference numerals preceded by the numeral 1 are used to indicate like elements.

The apparatus 110 includes a handle 124 which has a generally rectangular shape defining two side bars 128 and a cross bar 130. The side bars 128 are received within corresponding apertures 132, as shown in FIG. 7, extending through the legs 105 of the handle 101. Each leg 105 also defines an elongated aperture 134 within its inner surface and extending along the base of the respective aperture 132, which is dimensioned to permit the cross bar 130 to slide within said aperture.

The boss 103 also defines an elongated, U-shaped slot 135 within its top surface 136 for receiving the cross bar 130, as shown in FIGS. 5 and 6. The top edges of the slot 135 define lobes 138 which project toward each other so as to restrict the opening of the slot. The space between the lobes 138 is dimensioned to be slightly less than the thickness or diameter of the cross bar 130. Thus, when the cross bar 130 is pushed into the slot, the resilient lobes 138 engage the cross bar by friction and are slightly deflected outward to permit the cross bar to pass between the lobes and into the slot. Once the cross bar 130 is received within the slot 135, the lobes 138 retain the cross bar within the slot until a sufficient upward force is applied to the cross bar to cause it to clear the lobes thereby unlocking the handle.

In the operation of the apparatus 110, each handle 101 is moved into the closed position as shown in FIGS. 5 and 6 by rotating the handle upward and toward the lid so that the toothlike projections 104 are seated within the corresponding groove 106 in the lid. The apparatus 110 is then locked to fix the handle 101 (and thus the lid) in place, by pushing the handle 124 downward until the cross bar 130 is pushed between the lobes 138 and seated within the U-shaped slot 135. As a result, the handle 101 cannot be opened because it is locked in place by the cross bar 130 seated within the U-shaped slot 135.

The apparatus 110 can then be unlocked by pulling the handle 124 upward to remove the cross bar 130 from the U-shaped slot 135. The handle 101 can then be placed in the normal manner by simply pulling it downward and away from the lid.

One advantage of the apparatus 110 is that it can be manufactured as an integral part of the refuse container from any of numerous materials, such as a suitably durable, resilient plastic. The apparatus of the present invention thus provides a convenient, cost-effective mechanism for locking the lid onto a refuse container to prevent animals, for example, from gaining access to garbage within the container. While the animals either press or fall against the handles of the container, the apparatus of the present invention does not permit the handles to open when fixed in the locked position. The animals are neither clever enough, nor are they physically capable or sufficiently dexterous to unlock the apparatus. For example, simply pushing against the handles 24 or 124 with a nose or paw will not unlock the apparatus. These handles must be pulled in an upward motion in order to unlock the apparatus which can only be conveniently performed by a human hand. Thus, the apparatus of the present invention is easily operated by a human, yet substantially impossible to operate by a typical animal.

I claim:

1. An apparatus for securing a cover on a container, comprising:

at least one handle member pivotally mounted on the container for movement into a closed position for holding the cover on the container and movement into an open position for permitting removal of the cover from the container, the handle member including a first leg portion and a second leg portion spaced apart from the first leg portion; and a locking member coupled between the first and second leg portions of the at least one handle member for movement into a first position for securing the handle member in the closed position and for movement into a second position for permitting movement of the handle member into the open position, wherein the container defines a recess for receiving the locking member in the first position, and an entrance to the recess is shaped to engage the locking member by friction to facilitate retaining the locking member in the first position within the recess.

2. An apparatus as defined in claim 1, wherein the locking member is coupled to at least one handle member and is adapted to slide relative to the handle member for movement between the first and second positions.

3. An apparatus for securing a cover on a container, comprising:

at least one handle member pivotally mounted on the container for movement between a closed position for holding the cover on the container and an open position for permitting removal of the cover from the container, the handle member including a first leg portion and a second leg portion spaced apart from the first leg portion;

a locking member coupled on one end to the first leg portion and coupled on the other end to the second leg portion, the locking member being slidable relative to the at least one handle member along the first and second leg portions; and a clamp member located on the container between the first and second leg portions of the at least one handle member, the locking member being received within the clamp member when the at least one handle member is in the closed position to hold the cover on the container, and the locking member being releasable from the clamp member to pivot the at least one handle member to the open position to remove the cover from the container.

4. An apparatus as defined in claim 3, wherein the clamp member defines a generally U-shaped recess for frictionally receiving the locking member.

5. An apparatus as defined in claim 3 further comprising a U-shaped handle coupled to the locking member for manually gripping and moving the locking member into and out of the clamp member.

6. An apparatus as defined in claim 3, further comprising at least two C-clamp members, each C-clamp member being coupled between the locking member and a respective leg portion of the handle member thereby permitting the locking member to slide relative to the leg portions of the handle member.

7. An apparatus as defined in claim 3, further comprising a second-handle member extending through respective apertures defined in each leg portion of the handle member and coupled to the locking member for moving the locking member toward and away from the clamp member.

8. An apparatus as defined in claim 7, wherein each leg portion defines a second aperture for receiving the locking member, and the locking member is moved toward and away from the clamp member within the second apertures.

9. An apparatus for securing a lid on a refuse container, comprising:

at least one handle mounted on the container to pivot between a closed position for holding the lid on the container and an open position for removing the lid from the container, and including a first leg spaced apart from a second leg; and a locking member extending between the first and second legs of the at least one handle and moveable relative to the first and second legs of the handle between a locked position for securing the handle in the closed position to prevent access to the interior of the container and an unlocked position for permitting removal of the lid from the container, wherein the locking member is received within a recess formed on the container for retaining the locking member in the locked position, and an entrance to the recess is defined by a surface shaped to engage the locking member by friction upon movement of the locking member into the locked position to facilitate retaining the locking member in the locked position.

10. An apparatus as defined in claim 9, wherein the recess is defined by a clamp mounted on the container and including a spring-biased surface for engaging the locking member and facilitating retaining the locking member in the locked position.

11. An apparatus as defined in claim 9, further comprising at least one second handle coupled to the locking member for moving the locking member between the locked and unlocked positions.

12. An apparatus as defined in claim 11, wherein the at least one second handle extends through respective apertures defined in each leg of a handle.

13. An apparatus as defined in claim 9, wherein each leg defines a generally elongated aperture for receiving the locking member and for movement of the locking member within the elongated apertures between the locked and unlocked positions.

14. An apparatus for securing a cover on a refuse container, comprising:

a handle mounted on the container for pivoting between a first position for securing the cover on the container and a second position for removing the cover from the container;

a locking member coupled to the handle member and movable between a locked position for locking the handle in the first position and an unlocked position for pivoting the handle into the second position; and means for securing the locking member in the locked position for preventing access to the interior of the container, wherein the means for securing includes a recess defined on the container for retaining the locking member in the locked position, and an entrance to the recess is defined by a surface shaped to engage the locking member by friction upon movement of the locking member into the locked position to facilitate retaining the locking member in the locked position.

15. An apparatus as defined in claim 14, wherein the recess is defined by a clamp mounted on the container and including a spring-biased surface for engaging the locking member and retaining the locking member in the locked position.

16. An apparatus as defined in claim 14, wherein the handle includes first and second leg portions spaced apart from each other, and each leg portion defines a generally elongated aperture for receiving an end of the locking member for permitting movement of the locking member between the locked and unlocked positions within the elongated apertures.

* * * * *